US007628566B2

(12) United States Patent
Miskovich

(10) Patent No.: US 7,628,566 B2
(45) Date of Patent: Dec. 8, 2009

(54) SMOOTH INTERIOR WATER COLLECTION AND STORAGE ASSEMBLY

(76) Inventor: Joseph S. Miskovich, 8472 Sandwood Dr., Fenton, MI (US) 48430

( * ) Notice: Subject to any disclaimer, the term of this patent is extended or adjusted under 35 U.S.C. 154(b) by 0 days.

(21) Appl. No.: 12/018,265

(22) Filed: Jan. 23, 2008

(65) Prior Publication Data

US 2008/0181725 A1 Jul. 31, 2008

Related U.S. Application Data

(63) Continuation-in-part of application No. 11/744,016, filed on May 3, 2007.

(60) Provisional application No. 60/897,326, filed on Jan. 25, 2007.

(51) Int. Cl.
*E02B 13/00* (2006.01)

(52) U.S. Cl. ..... 405/49; 405/46

(58) Field of Classification Search ..... 405/49, 405/46, 44, 43

See application file for complete search history.

(56) References Cited

U.S. PATENT DOCUMENTS

| | | | | |
|---|---|---|---|---|
| 980,442 | A | 1/1911 | Schlafly | |
| 4,182,580 | A | 1/1980 | Hieda | |
| 4,182,581 | A | 1/1980 | Uehara | |
| 4,950,103 | A | 8/1990 | Justice | |
| 5,335,945 | A | 8/1994 | Meyers | |
| 5,839,447 | A | 11/1998 | Lesser | |
| 5,921,711 | A | 7/1999 | Sipaila | |
| 5,996,635 | A | 12/1999 | Hegler | |
| 6,076,992 | A | 6/2000 | Fukui | |
| 6,361,248 | B1 | 3/2002 | Maestro | |
| D465,545 | S | 11/2002 | Maestro | |
| D469,187 | S | 1/2003 | Maestro | |
| 6,612,777 | B2 | 9/2003 | Maestro | |
| 6,719,490 | B2 | 4/2004 | Maestro | |
| 6,854,925 | B2 | 2/2005 | DiTullio | |
| 6,994,490 | B2 | 2/2006 | Maestro | |
| 2004/0101369 | A1 * | 5/2004 | DiTullio | 405/49 |
| 2008/0240859 | A1 * | 10/2008 | Sipaila | 405/49 |

* cited by examiner

*Primary Examiner*—Frederick L Lagman
(74) *Attorney, Agent, or Firm*—Miller, Canfield, Paddock and Stone PLC

(57) ABSTRACT

A water collection and storage assembly for dispersion of water comprises a half pipe assembly comprising at least one half pipe having an inlet, an outlet, a top, a bottom, a corrugated exterior comprising alternating ribs and valleys, and at least one side port positioned above the bottom of the half pipe, and a sleeve positioned in an installed position within the half pipe and defining a smooth interior, wherein the sleeve extends from the bottom of the half pipe to a height less than the at least one side port. The half pipe assembly can define a chamber and the sleeve has a dimple which extends into the chamber. The sleeve can have an opening which allows projections of the port hole to extend through the opening and into the chamber.

9 Claims, 13 Drawing Sheets

SMOOTH INTERIOR WATER COLLECTION AND STORAGE ASSEMBLY

RELATED APPLICATION

This application is a continuation-in-part of U.S. Utility patent application Ser. No. 11/744,016 filed May 3, 2007 and claims priority benefit of U.S. Provisional Patent application 60/897,326, filed on Jan. 25, 2007.

FIELD OF THE INVENTION

This invention relates to a water collection device, and more particular to improved underground water collection and storage assembly.

BACKGROUND OF THE INVENTION

Culverts, catch basins, and storm sewers are commonly used for collecting and conveying water. In some instances such water is discharged directly into the nearest available water body. This is considered undesirable due to potentially adverse environmental effects. Water management facilities have been constructed to help manage the quantity and quality of the water. Wet or dry retention or detention basins/ponds represent the most common structural approach to water management. Although more environmentally sound then direct discharge into an existing water body, such water management approaches preclude other uses of the land. This is of particular importance where land values are high and/or space is limited. The open ponds may also be undesirable in locations near airports because of birds attracted by the pond, or in locations where health, liability or aesthetic considerations make them undesirable. Even the use of "dry" detention basins frequently results in the same types of problems associated with wet ponds.

Underground systems have also been developed to help manage water and/or sewage system effluent. Those systems most commonly used include rows of large diameter pipe with a relatively small pipe protruding at the upper end of the pipe to retard flow for sediment deposition; infiltration trenches, which are basically excavations filled with stone and fed via drain pipes; and sand filters-typically large, partitioned concrete boxes with an initial compartment for sediment deposition and a following compartment with sand and under-drains for water filtration. Plastic arch shaped, open-bottomed water chambers are highly preferable to other types of underground water management systems for several reasons. They are typically less expensive, they are easier to maintain, they have a longer effective life. Also, unlike some other types of underground water management devices, plastic arch shaped open-bottomed water chambers can be located under paved areas.

In a typical installation of open-bottomed water chambers elongated hollow plastic half pipes are placed in the ground to form a leaching field for receiving water and gradually dispensing it into the surrounding earth. Such chambers have a central chamber for receiving inflow water. An open bottom allows water to exit the central chamber and disperse into the surrounding earth. The half pipes are usually connected together to form a multi-row array that constitutes a leaching field. The water is generally conducted to the array of rows by a large diameter header manifold pipe that runs orthogonal to the rows closely adjacent one extremity thereof, and the array looks something like an underground pipe storage system. Short feeder conduits convey the water from the header pipe to the end wall of the first chamber of each row. The pipes are generally engulfed in coarse backfill such as gravel or rock. Above the backfill is compacted soil and sometimes a paved cover surface. The resulting assembly may be used as a parking lot, roadway, sports field or for other uses.

The header pipe often comprise 12 or 24 inch diameter or larger high density polyethylene (HDPE) pipes with HDPE tees. It is not unusual for such a header pipe (manifold) system to be comprised of over 200 feet of HDPE pipe and 50 HDPE tees. A header pipe system of this type becomes very expensive and could easily add significant cost to the water management system and require significant additional area for installation.

In order to sustain the considerable downward forces imposed by the surrounding backfill and overhead vehicular traffic, the chambers are generally of arch-shaped configuration having a corrugated cross section. The corrugations consist of a continuous sequence of ridges or peaks separated by valleys so that the ridges and valleys extend on both sides of the pipe—inside the chamber and outside the chamber. The peaks and valleys are connected by web portions disposed in planes substantially orthogonal to the axis of elongation of the chamber. Examples of such corrugated pipes are found in U.S. Pat. No. 6,612,777 to Maestro, for example. However, the irregular interior walls of these storage chambers result in turbulence and secondary flow vortexes within the runoff being collected in the chambers from the surface. The turbulence and secondary flow vortexes leads to the uneven and random settling of sediments contained in the surface runoff throughout the length of the chambers. This uneven and random settling of sediments can therefore result in the accumulation of fine sediments. Moreover, corrugated pipes such as those disclosed in Maestro are made using a vacuum forming process which requires heating the raw material to a soft, substantially-molten state and then drawing a vacuum on the raw material to form the desired shape. The vacuum forming process greatly limits the ability to use strength enhancing additives in the half pipe.

It would be desirable to provide a water collection and storage assembly which reduces the problems resulting from of turbulence and secondary flow vortexes while maintaining the necessary strengths to support the weight of the earth and construction loaded above the pipes in the drainage area. It would also be desirable to provide a water collection and storage assembly which allows for the collection of sediments at specific collection points within the chambers so that the sediments could be easily accessible for removal through designated manholes.

From the foregoing disclosure and the following more detailed description of various preferred embodiments it will be apparent to those skilled in the art that the present invention provides a significant advance in the technology and art of water collection and storage assembly devices. Particularly significant in this regard is the potential the invention affords for providing a high quality, low cost, water collection and storage assembly with improved sediment removal. Additional features and advantages of various preferred embodiments will be better understood in view of the detailed description provided below.

SUMMARY OF THE INVENTION

In accordance with a first aspect, a water collection and storage assembly for dispersion of water comprises a half pipe assembly comprising at least one half pipe having an inlet, an outlet, a top, a bottom, a corrugated exterior comprising alternating ribs and valleys, and at least one side port positioned above the bottom of the half pipe, and a sleeve positioned in an installed position within the half pipe and defining a smooth interior, wherein the sleeve extends from the bottom of the half pipe to a height less than the at least one side port. In accordance with another aspect, the half pipe assembly defines a chamber and the sleeve has a dimple which extends into the chamber. In accordance with another aspect, the sleeve has an opening which allows projections of the port hole to extend through the opening and into the chamber.

From the foregoing disclosure and the following more detailed description of various preferred embodiments it will be apparent to those skilled in the art that the present invention provides a significant advance in the technology and art of water collection and storage devices. Particularly significant in this regard is the potential the invention affords for providing a high quality, low cost, seat assembly adapted for specialized design constraints. Additional features and advantages of various preferred embodiments will be better understood in view of the detailed description provided below.

Figure 1:
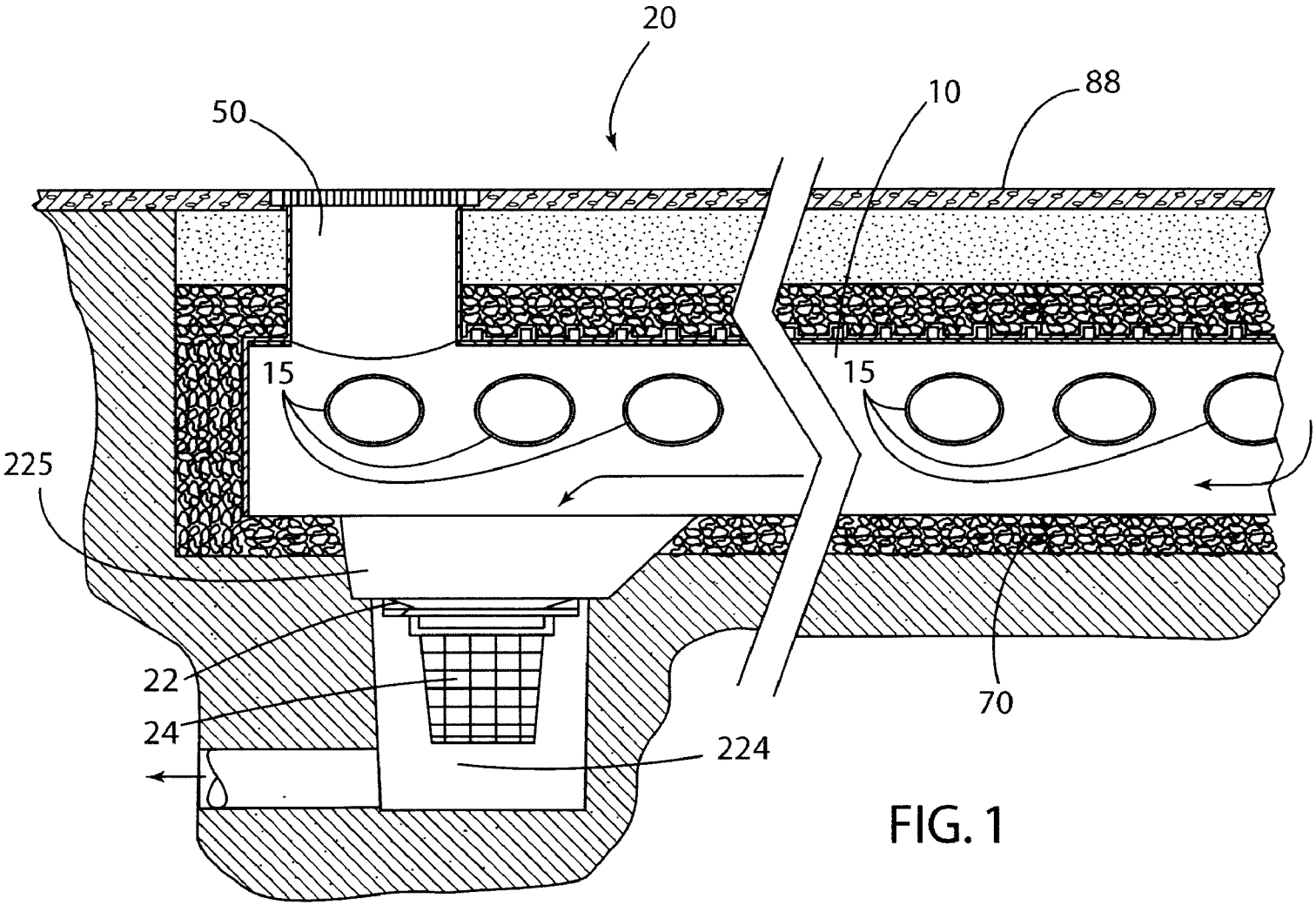
FIG. 1 is a schematic side view of an assembled water collection and storage assembly device in accordance with a preferred embodiment

It should be understood that the appended drawings are not necessarily to scale, presenting a somewhat simplified representation of various preferred features illustrative of the basic principles of the invention. The specific design features of the water collection and storage assembly as disclosed here will be determined in part by the particular intended application and use environment. Certain features of the illustrated embodiments have been enlarged or distorted relative to others to help visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the water collection and storage assembly disclosed here. The following detailed discussion of various alternative and preferred features and embodiments will illustrate the general principles of the invention with reference to a water collection and storage assembly suitable for use in urban areas. Other embodiments suitable for other applications will be apparent to those skilled in the art given the benefit of this disclosure.

Figure 2:
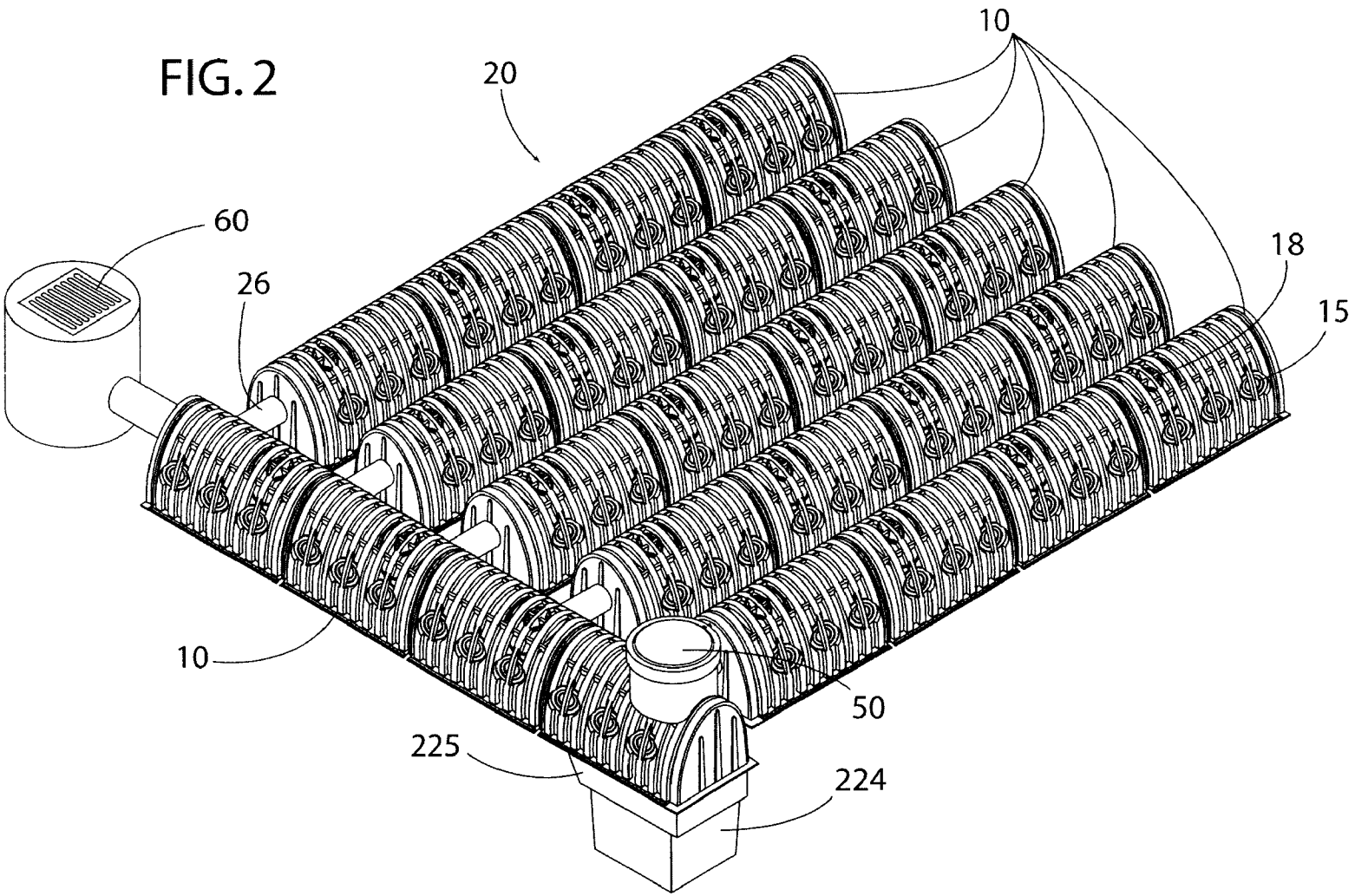
FIG. 2 is a perspective view of an assembled water collection and storage assembly device in accordance with the preferred embodiment of FIG. 1.

Referring now to the drawings, FIG. 1 shows a side view of a water collection and storage assembly 20 buried below a surface 88 in accordance with a preferred embodiment. Storm water enters a chamber defined by the assembly from the right as shown by the flow arrow. A half pipe assembly comprises a series of half pipes 10 connected together at one or more ports and define the chamber which receives the water. The assembly 20 may be positioned in a porous bed. The half pipes have a generally arcuate or C-shaped shape cross section comprising side walls 65, with a slightly widened base 66, designed to withstand loading from above, and are open on their bottom so that they sit on the gravel bed. This allows water to diffuse into the gravel bed. Storm water flows from the half pipe assembly to an angled dumpster 225 to a bin 224. Optionally a sump box 24 s positioned in the bin 224. The sump box 24 may be provided with a filter 22 to allow for additional filtration prior to water exiting the assembly. FIG. 2 shows a perspective view of the assembly 20 with the gravel removed. A series of half pipes 10 can be connected to a manifold pipe by connector pipes 26 to form a leaching field. Typically sizes of the half pipes are twelve or twenty-four inches in diameter and the leaching field can be, for example, about fifty to one hundred square feet. The half pipes may also be connected to each other, either through side ports 15 or top ports 18 (for example, when the half pipes are layered on top of each other), as needed. Water flows into the assembly from drain 60, through the half pipes and either diffuses through the gravel bed below or travels to an outlet. Optionally, the sump may be positioned between the half pipes and the outlet, below the half pipe. The outlet may be positioned in a wide range of locations, from the bottom of the sump to the top of the half pipe depending on desired outlet flow. An access 50 may be provided to allow for cleaning and service.

Figure 3:
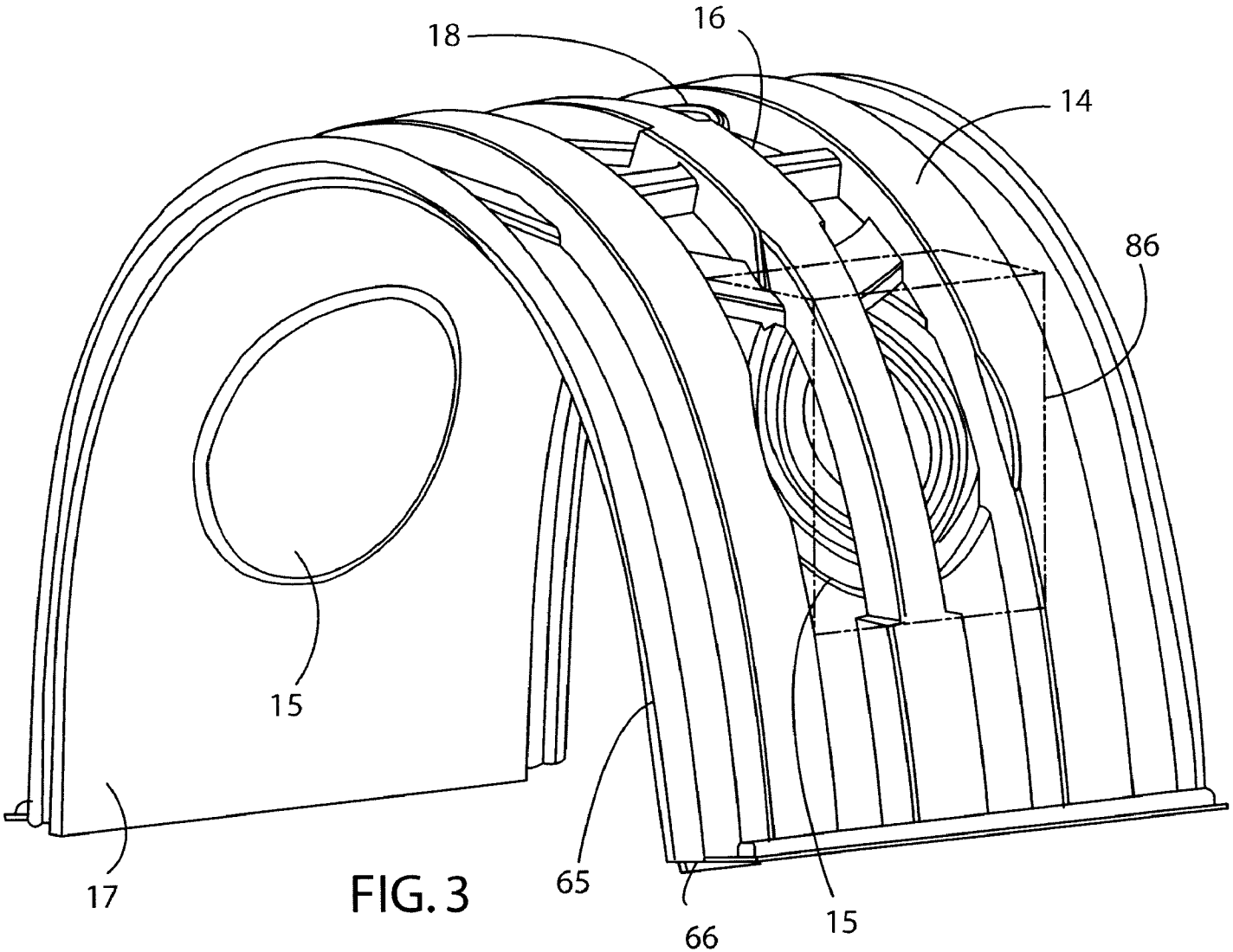
FIG. 3 is an isolated perspective view of a preferred embodiment of a half pipe which defines a chamber that receives water, showing a smooth interior.
Figure 4:
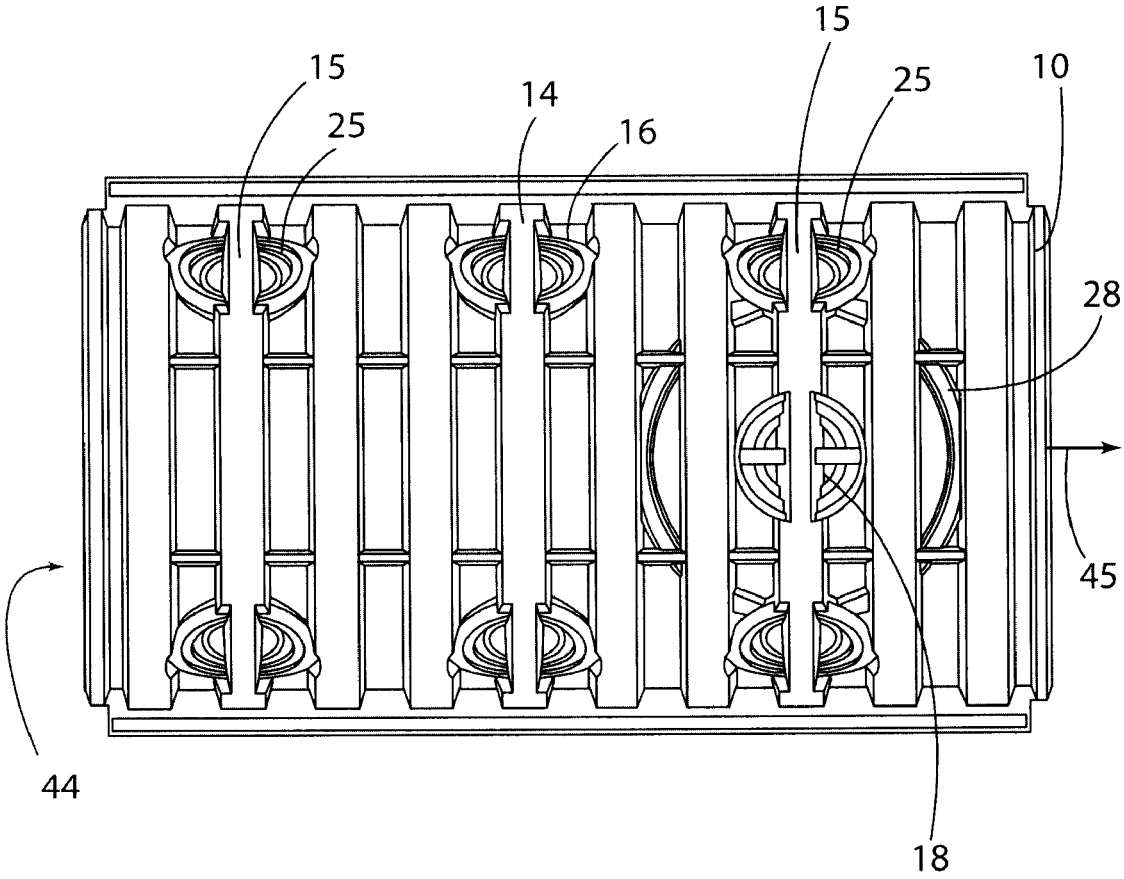
FIG. 4 is a top side view of the half pipe of FIG. 3.

FIG. 4 shows an isolated piece of half pipe 10. Each half pipe has an inlet 44 and an outlet 45, and each half pipe assembly has an interior 17 which is the side exposed to the water, and an exterior which is the side opposite the interior. The interior cooperates with the gravel bed to define a chamber. As used herein, the chamber includes the open area between the interior and a bottom surface for all of the half pipes used in the assembly. The bottom surface may simply be gravel, crushed stone, or any other porous material, or may comprise a filter floor as discussed in greater detail below. The half pipe 10 is provided with a corrugated surface on its exterior having alternating ribs 14 and valleys 16. However, in accordance with a highly advantageous feature, the interior 17 of the half pipe assembly has a non-corrugated or smooth surface. In the embodiment shown in FIG. 3, the half pipe assembly smooth interior is formed as a unitary portion of the half pipe, that is, the smooth interior is an extension of the half pipe. Use of a smooth interior advantageously reduces turbulent flow of water which would otherwise result in eddies where sand and gravel may accumulate, potentially clogging the half pipes. Also, the bottom surface of the leaching field can become clogged with such sediment. Preferably the half pipes 10 are formed with side ports 15 and top ports 18 closed. The pieces of the half pipe at the ports 15,18 may be cut away during assembly only where needed.

FIG. 3 also shows that the side ports preferably do not lie in a vertical plane 86. Therefore, the side ports are formed as openings in the walls having a non-circular, elliptical shape to account for the difference between walls 65 and the vertical plane 86. Adjusting the shape of the side ports in this way is highly advantageous in that it allows the half pipe to be designed with increased strength.

Figure 5:
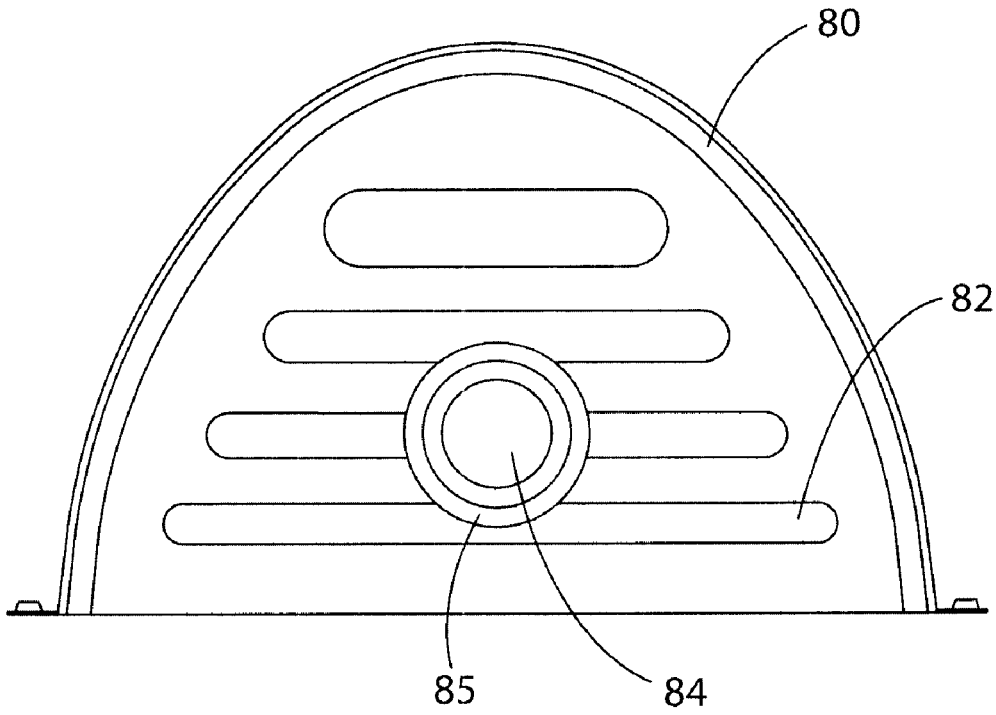
FIG. 5 is a side view of an end cap with an optional port.

FIG. 4 shows a top side view of a half pipe 10 with water inlet 44 on the right and outlet 45 on the left. Each of the ports 15,18 is provided with circumferential reinforcing ribs 25, 28 respectively which help identify and strengthen the location adjacent the ports, as well as provide guidance for where to cut the openings to form the ports. The inlets and outlets may be closed off, depending upon their particular location, by end caps such as the one shown in FIG. 5. End cap 80 may be provided with reinforcing ribs 82, as well as with an inlet/outlet port 84. The port 84 may have circumferential reinforcing ribs 85 similar to circumferential reinforcing ribs 25 and 28 shown in FIG. 4.

Figure 6:
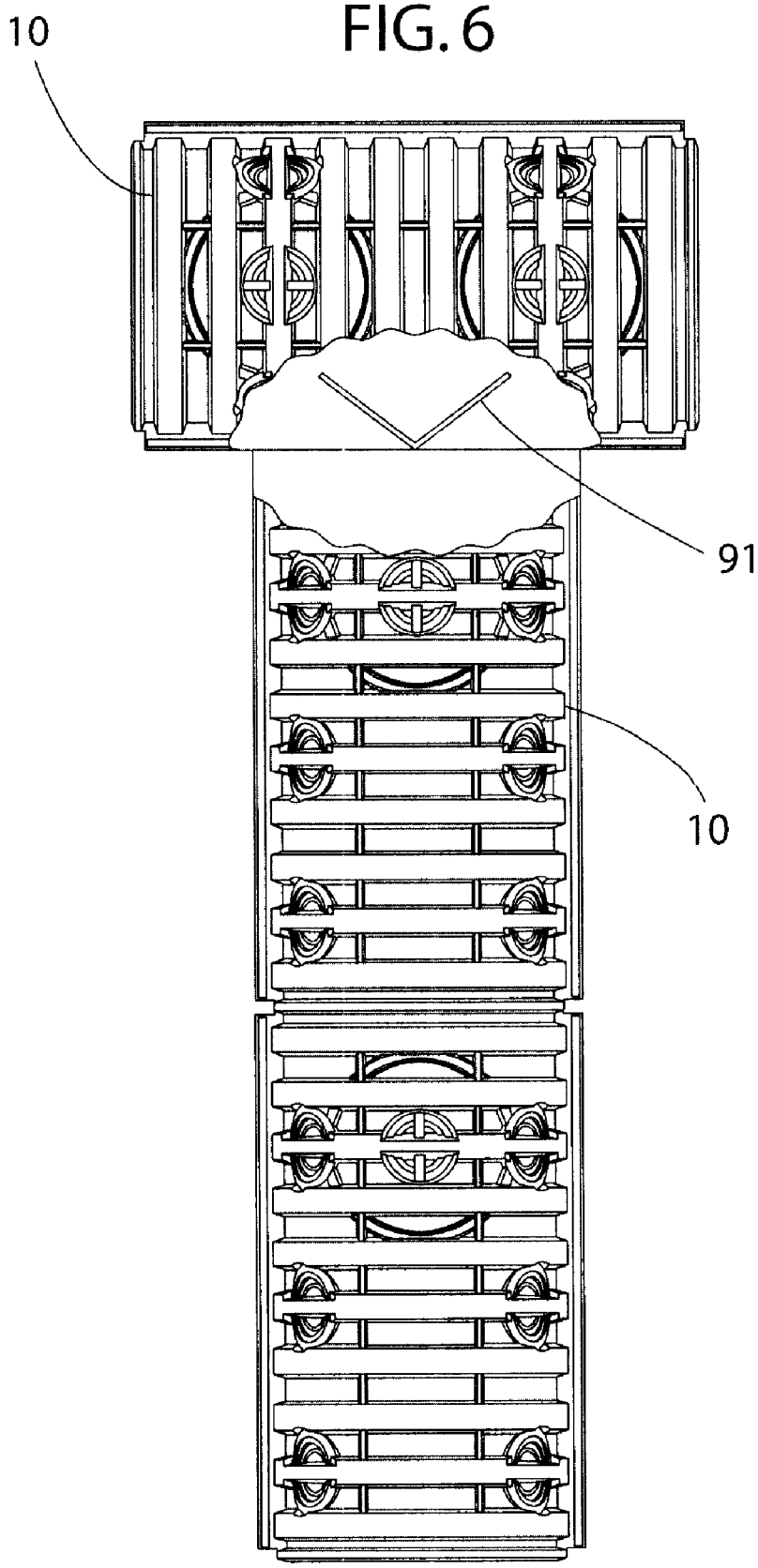
FIG. 6 is a top side view showing a junction where a half pipe connects to another pipe, partially cut away to reveal a diverter.
Figure 7:
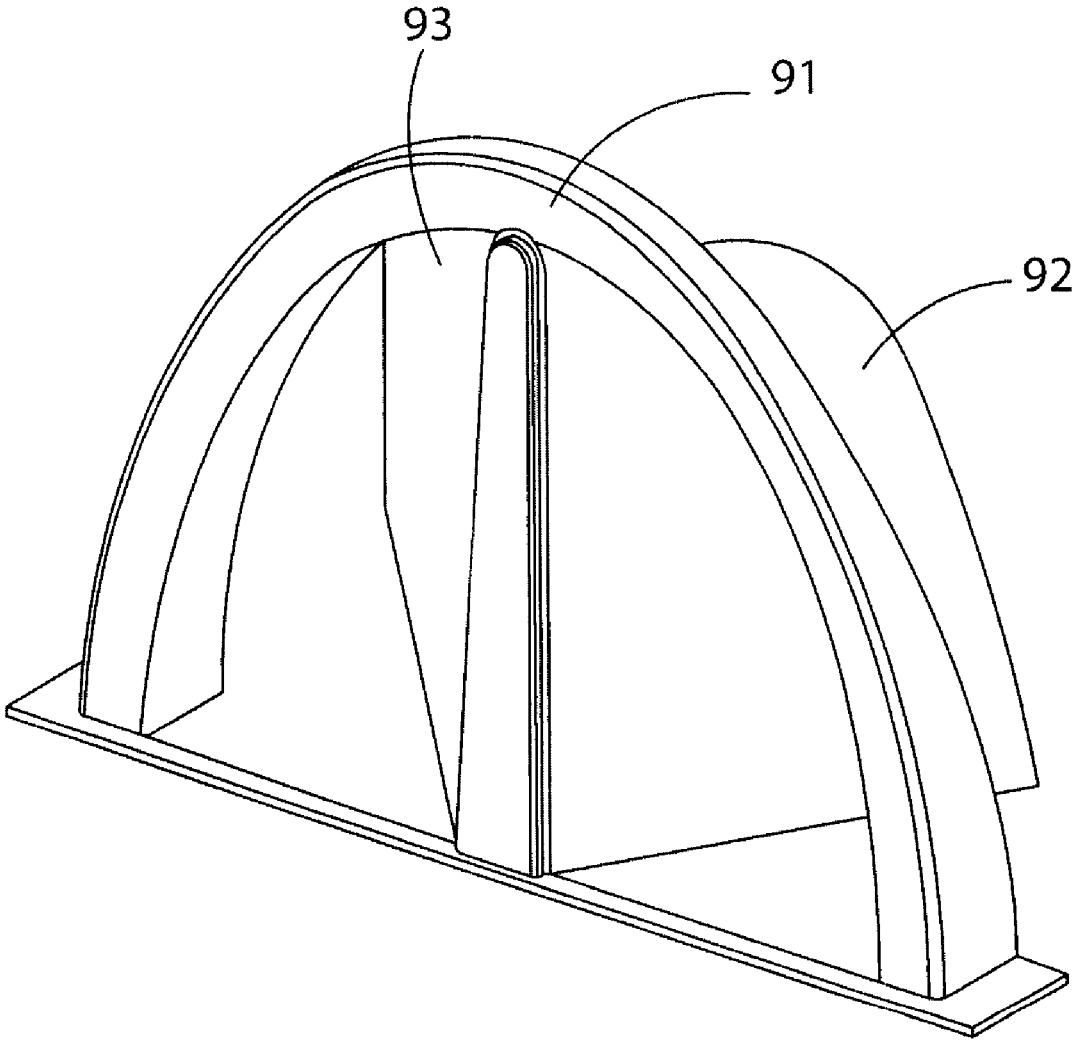
FIG. 7 is an isolated perspective view of the diverter.

FIGS. 6-7 shows an example of the use of a diverter 91. Diverter 91 may be positioned at the junction between a pair of half pipes, or between the manifold and a half pipe. By forcing water around the flanges 92, 93 of the diverter, the water is forced to change directions and therefore slow down. When water slows it loses the energy necessary to support some particulate matter. Therefore the use of the diverter 91 makes it possible to partially control the location that particulate matter settles. For example, a diverter may be positioned generally below an access to allow for ease of removal of sediments.

The water collection and storage assembly typically is surrounded and covered by fairly heavy materials such as gravel, rock bed, sand, fill and the impervious product at the surface of the drainage area such as asphalt or concrete. In addition to withstanding high loading the assembly needs to resist the degrading effects of salts, chemicals and other compounds that are typically found in water runoff from roadways and parking lots. In accordance with a highly advantageous feature the half pipes comprise a reinforced resin such as a glass fiber filled resin, etc. such as sheet molding compound (SMC) or a recycled resin such as polyethylene terephthalate (PET) or polypropylene with glass fibers added for strength. Use of a glass fiber filled resin not only advantageously increases the strength of the half pipes, but also allows for use of a thinner cross section and allows for the use of a smooth non-corrugated interior. Glass fiber resins, due to their stiffness, are not suitable materials for vacuum molding. Instead, half pipes may be formed in a thermoplastic flow forming process by introducing the glass fiber filled resin into a mold and compressing the resin to form the desired shape.

Figure 8:
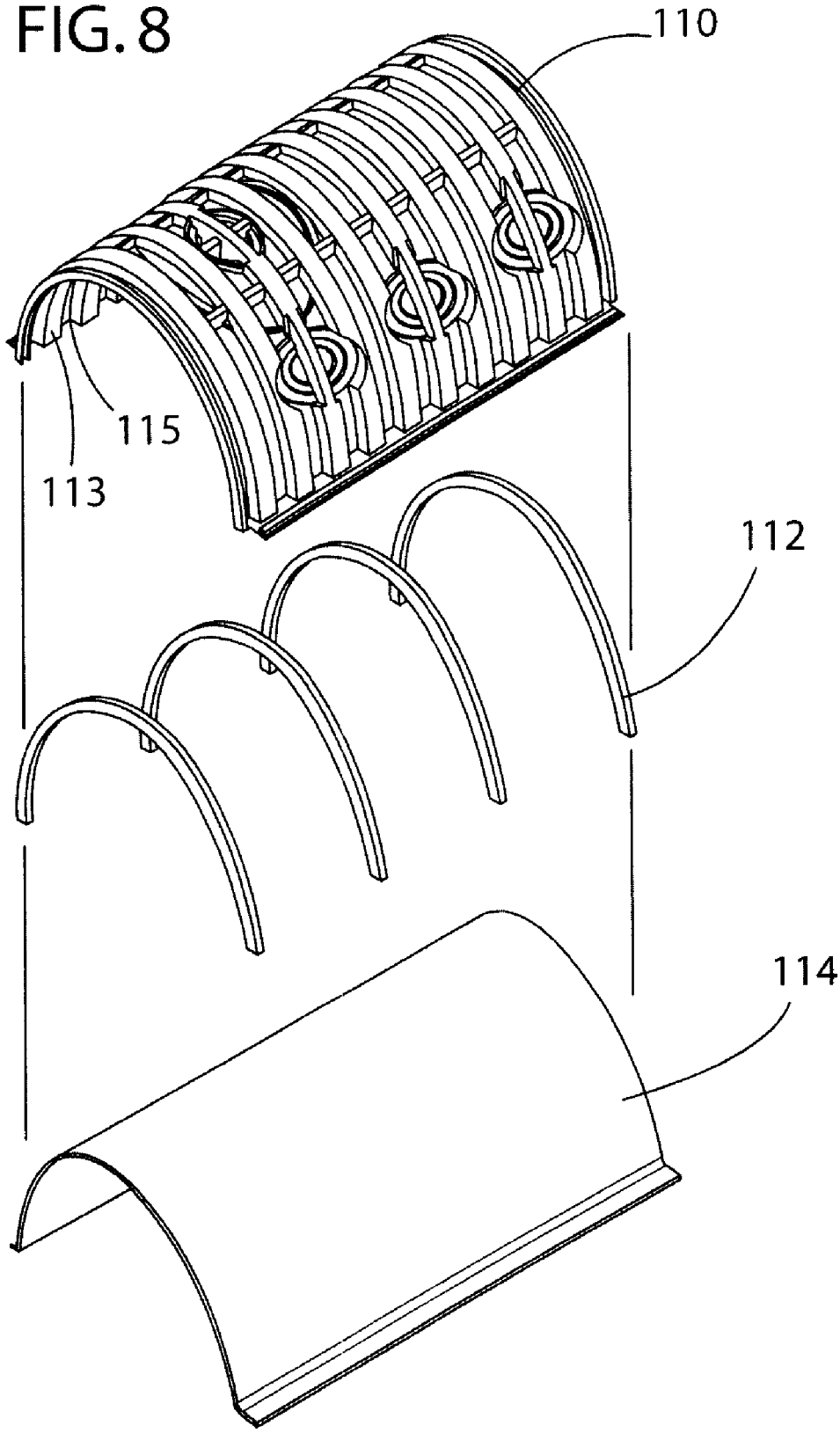
FIG. 8 is an exploded perspective view of an alternate preferred embodiment where the half pipe is corrugated on both its outside and inside, reinforcing ribs are provided and a smooth insert is provided to help define the chamber for water.

FIG. 8 shows an alternate preferred embodiment where the half pipe 110 is corrugated on both the exterior and its inside surface, with ribs 113 and valleys 115. Reinforcing structural frame members 112 may be provided preferably made of a stainless steel or other structural non-corroding material, to help reinforce the half pipe. To reduce eddy generation, a sleeve 114 having a smooth interior may be inserted into the chamber, covering the inside surface of the half pipe. The portion of the interior which is smooth (non-corrugated) corresponds to the portion of the interior defined by the sleeve. The sleeve can be attached to the half pipe by heat welding, by rivets, screws, adhesive or other suitable fastener.

Figure 9:
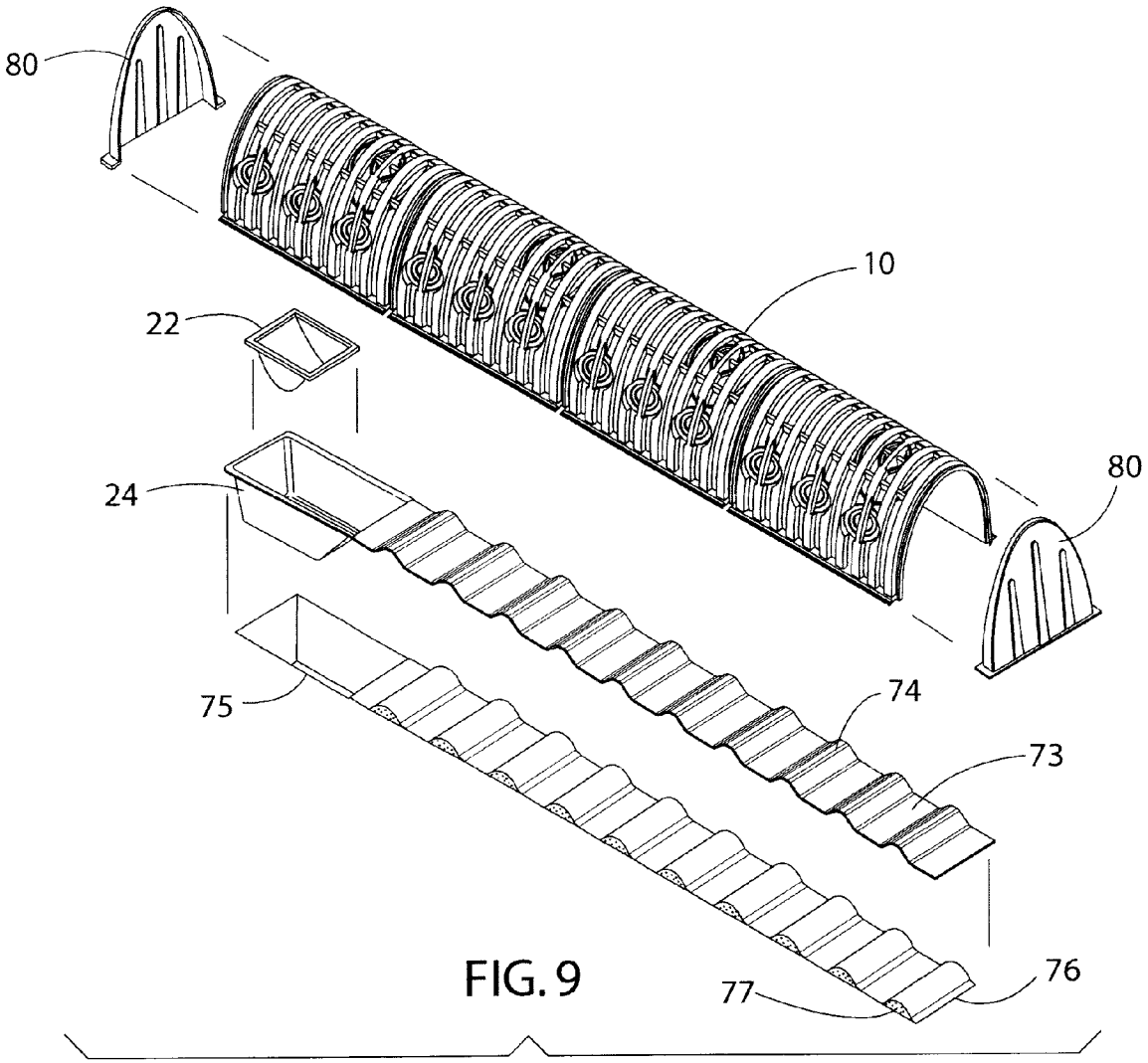
FIG. 9 is an exploded perspective view of various optional features, including liners on the bed and a catch drain.

FIG. 9 shows additional elements which may be added to the assembly as desired. Instead of positioning a half pipe 10 on a gravel bed, optionally a filter floor 76 connected to hole or drain 75 may be provided. The filter floor may comprise a substantially-porous material provided with a series of filtration media 77 (comprising, for example, sand or peat, or any other commercially available product that helps in filtration of water) shown formed as a series of ridges forming a wave pattern over which the water travels. At various service intervals the filter floor may be replaced. In addition the filter floor, a mesh 73 may be provided with surfaces 74 designed to accommodate the ridges of the filtration media, when present. The mesh may be porous or non-porous, depending upon intended use and can comprise, for example a porous mesh or a non-porous plastic sheeting. When a non-porous sheeting is used, typically a filter floor would not be required and the sheeting would be generally flat and would not have surfaces 74. Optionally a sump 24 may be provided. The sump is designed to hold sediments that would be contained in the flow of water being transferred through the half pipe assembly. The sump might be shallow or deep depending on the loading of materials contained within the flow and the length of time between projected cleanouts. A filter 22 immediately above the sump may also be provided. Use of one or more of filtration media, meshes and sumps allows the water collection and storage assembly to help with water quality in addition to its intended water quantity management function.

Figure 10:
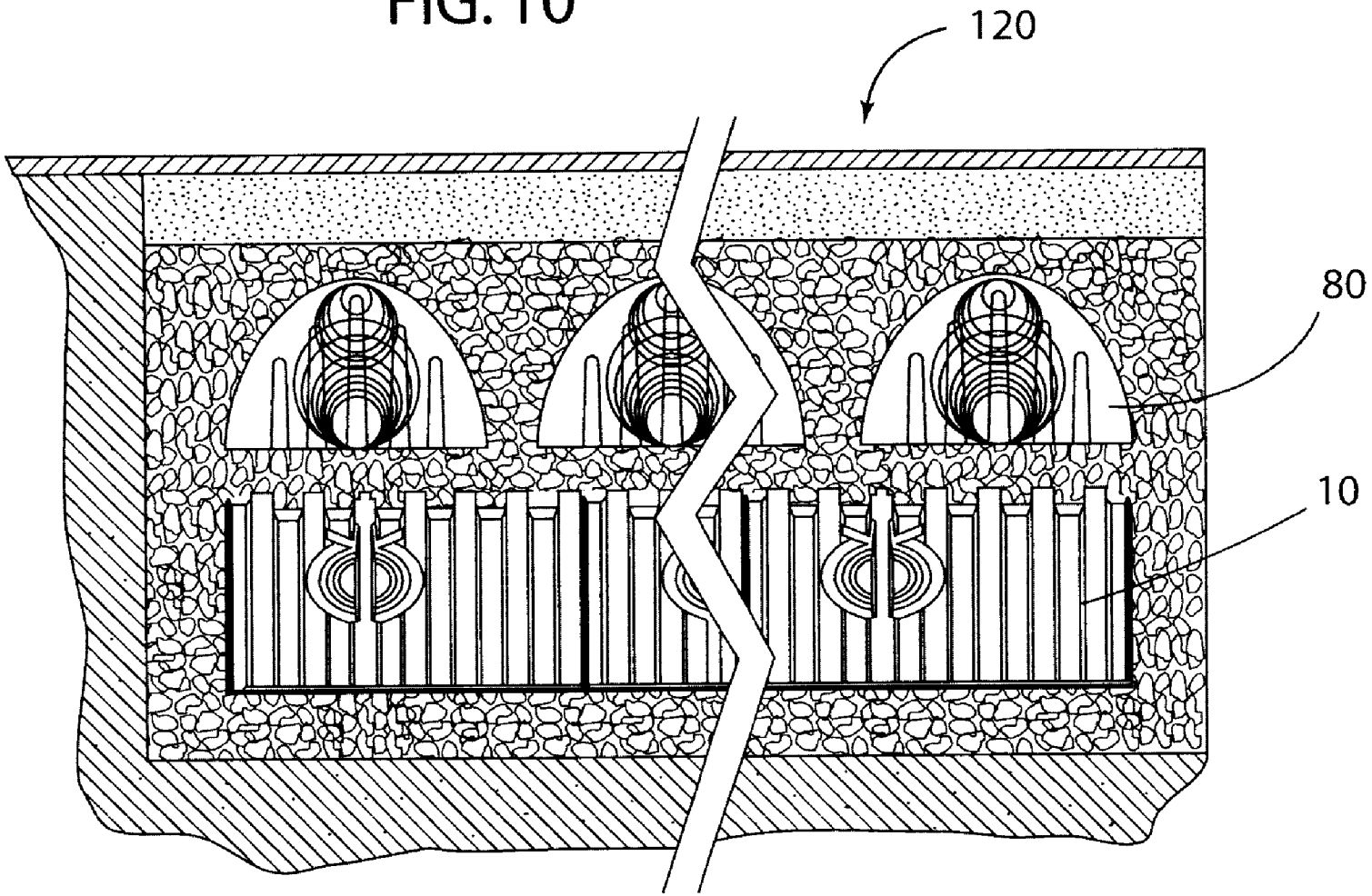
FIG. 10 is a side view of an alternate preferred embodiment of a water collection and storage assembly device, showing a double stack configuration.

FIG. 10 shows an alternate preferred embodiment of a water collection and storage assembly 120 where half pipe assemblies are stacked one on top of each other. In this situation, the bottom row of half pipe assemblies may be connected to the top row of half pipe assemblies through the top ports. Such a design may be particularly useful where the available space for the placement of the half pipes is limited.

Figure 11:
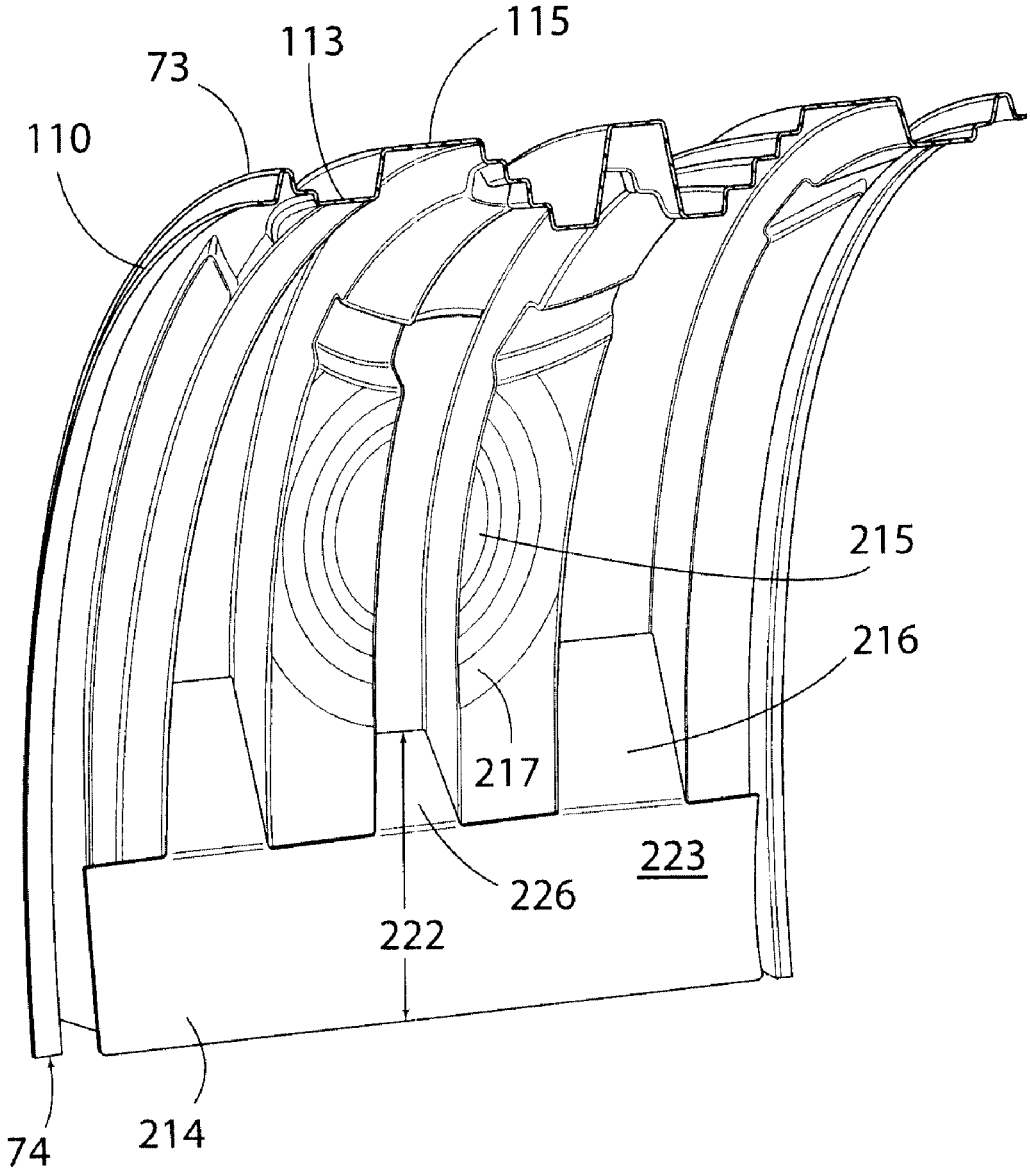
FIG. 11 is an isolated perspective view of another preferred embodiment showing a smooth interior formed by a sleeve extending partially up the half pipe.

FIG. 11 shows another preferred embodiment with a sleeve 214 which only extends from the bottom (as shown) of the half pipe assembly up a height 222 preferably below a side height defined as a lowermost portion of a side port 215 and most preferably less than a lowermost height of an outermost circumferential reinforcing rib 217. Liner tabs 216, 226 extend from a main body 223 of the sleeve into valleys 115 of the half pipe 110 to close off the valleys, helping to prevent water and debris from getting caught between the sleeve and the half pipe. Such a sleeve/liner embodiment is highly advantageous in that it reduces weight of the assembly and reduces costs while providing a smooth interior of the chamber in the area where it is most needed. Such a sleeve advantageously prevents storm water flow from the alternating ribs and valleys of the half pipe (at least up to a point where there is so much flow that turbulence is unavoidable). Thus the lower portion of the interior defined by the liner is smooth (non-corrugated).

Figure 12:
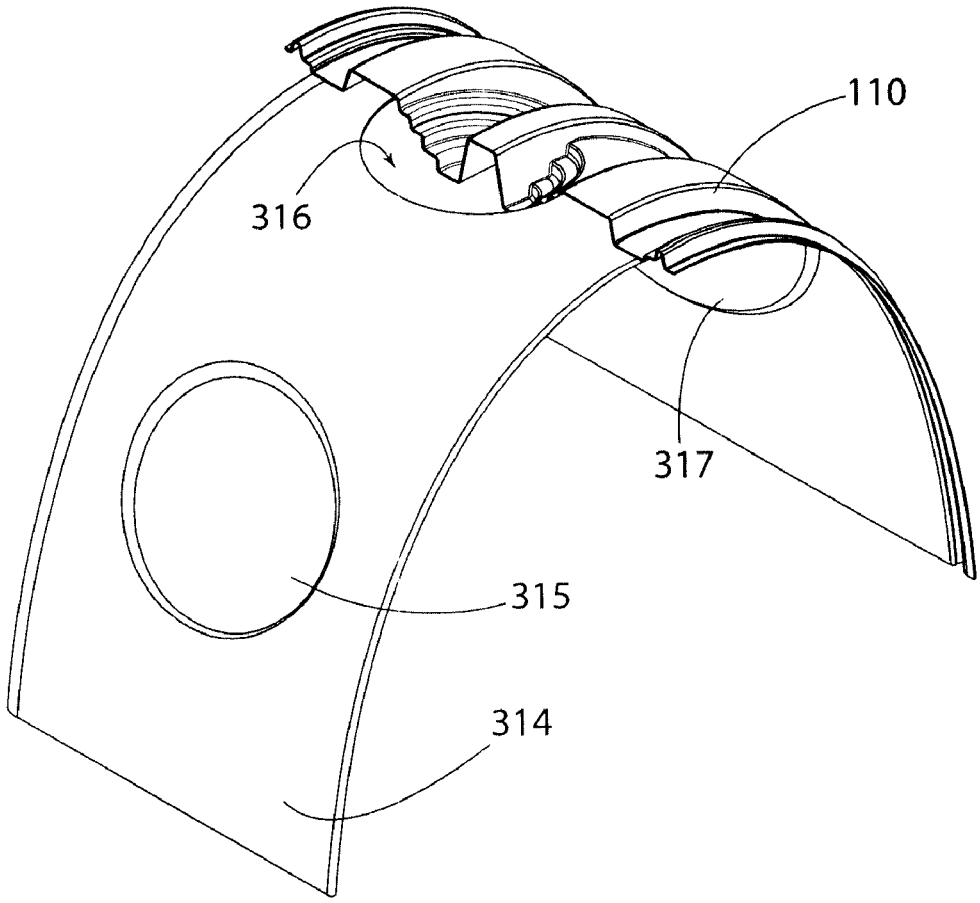
FIG. 12 is an isolated perspective view of another preferred embodiment of a half pipe showing a smooth interior defined by a sleeve having a dimpled surface corresponding to a side port on the half pipe.
Figure 13:
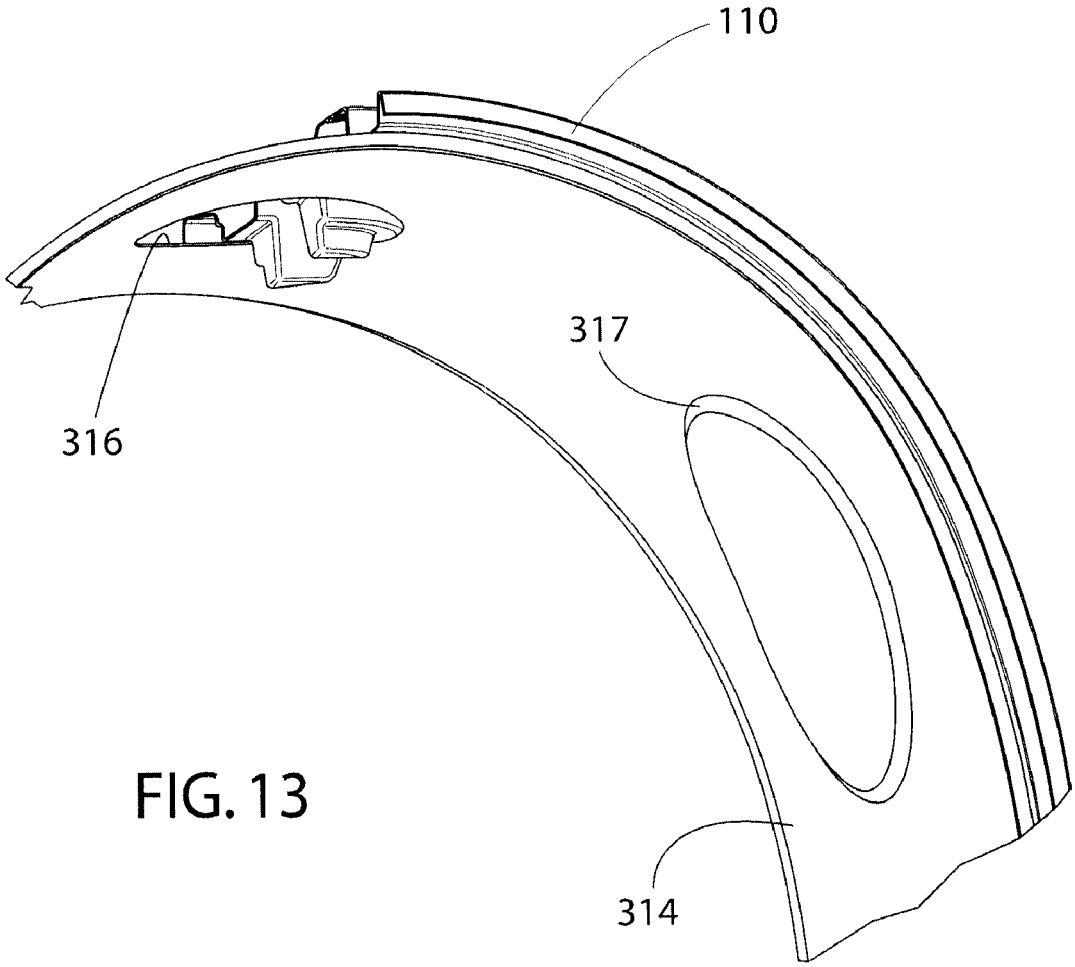
FIG. 13 is an isolated perspective view of the preferred embodiment of FIG. 12 showing an opening corresponding to a top port.

FIGS. 12-13 show another alternate preferred embodiment of a smooth interior water collection and storage assembly where a sleeve 314 is provided with dimples 315, 317 to accommodate projections and/or ribs formed adjacent side portals. The rest of the liner may be smooth, helping to ensure smooth flow of the storm water with resulting relatively even distribution of sediment, while the dimples help transition between the ribs adjacent side portals, thereby also helping to reduce turbulence. Also, where a top port is provided in the half pipe 110, a cut away opening 316 can be provided which aligns with the corresponding top port. FIG. 12 shows an outside of the liner/sleeve 314 with the recessed side of dimple 315; FIG. 13 shows an inside view of the liner with an extended side of dimple 317 (extending into the chamber). FIG. 13 also shows the opening 316 formed in the sleeve to allow for flanges, ribs or other projections related to a port hole (either top port hole, or side port hole, or both where present) to extend into the chamber.

From the foregoing disclosure and detailed description of certain preferred embodiments, it will be apparent that various modifications, additions and other alternative embodiments are possible without departing from the true scope and spirit of the invention. For example, optionally the half pipes may be provided with perforations in the walls to allow for the additional discharge of water. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A water collection and storage assembly for receipt and gradual dispersion of water comprising, in combination:

a half pipe assembly comprising at least one half pipe having an inlet, an outlet, a top, a bottom, a corrugated exterior comprising alternating ribs and valleys, and at least one side port positioned at a side height above the bottom of the half pipe; and a sleeve positioned in an installed position within the half pipe and defining a smooth interior, wherein the sleeve extends from the bottom of the half pipe to a height less than the side height of the at least one side port.

2. The water collection and storage assembly of claim 1 wherein the half pipe further comprises a reinforcing rib extending circumferentially around the side port, and the sleeve is positioned below the reinforcing rib.

3. The water collection and storage assembly of claim 1 wherein the sleeve comprises a main body and tabs wherein the tabs extend into corresponding valleys in the half pipe.

4. The water collection and storage assembly of claim 3 wherein one of the tabs is positioned immediately below one of the at least one side ports and does not extend up to the at least one side port.

5. The water collection and storage assembly of claim 1 wherein the half pipe assembly is positioned on a porous bed and water disperses into the porous bed; and a non-porous sheeting positioned over the bed.

6. The water collection and storage assembly of claim 1 wherein the half pipe assembly further comprises a plurality of half pipes, each connected to a manifold at a junction.

7. The water collection and storage assembly of claim 1 further comprising a non-porous filter floor positioned on the bottom of the chamber.

8. A water collection and storage assembly for receipt and gradual dispersion of water comprising, in combination:

a half pipe assembly defining a chamber and comprising at least one half pipe having an inlet, an outlet, a top, a bottom, a corrugated exterior comprising alternating ribs and valleys, and at least one side port positioned above the bottom of the half pipe; and a sleeve positioned in an installed position within the half pipe and defining a smooth interior of the chamber, wherein the sleeve has a dimple which extends into the chamber.

9. The water collection and storage assembly of claim 8 wherein the dimple covers the side port.

* * * * *